US011980285B2

(12) United States Patent
Wong

(10) Patent No.: US 11,980,285 B2
(45) Date of Patent: May 14, 2024

(54) HIGHLY FLEXIBLE SHELF DEVICE

(71) Applicant: Sap Products Limited, Dongguan (CN)

(72) Inventor: Sau Man Symon Wong, Kowloon (HK)

(73) Assignee: SAP PRODUCTS LIMITED, Guangdong (CN)

( * ) Notice: Subject to any disclaimer, the term of this patent is extended or adjusted under 35 U.S.C. 154(b) by 0 days.

(21) Appl. No.: 18/080,914

(22) Filed: Dec. 14, 2022

(65) Prior Publication Data

US 2023/0346121 A1 Nov. 2, 2023

(30) Foreign Application Priority Data

Apr. 27, 2022 (CN) ..... 202220998777.1

(51) Int. Cl.
*A47B 57/58* (2006.01)
*A47F 5/00* (2006.01)

(52) U.S. Cl.
CPC ..... *A47B 57/588* (2013.01); *A47F 5/005* (2013.01)

(58) Field of Classification Search
CPC ..... A47F 1/125; A47F 1/126; A47F 5/005; A47B 57/588
See application file for complete search history.

(56) References Cited

U.S. PATENT DOCUMENTS 4,830,201 A * 5/1989 Breslow ..... A47F 1/126 211/59.3
4,887,737 A * 12/1989 Adenau ..... A47F 1/126 221/192
5,185,948 A * 2/1993 Markson ..... G09F 3/204 248/296.1
5,665,304 A * 9/1997 Heinen ..... A47F 1/126 211/59.3

(Continued)

FOREIGN PATENT DOCUMENTS

GB 881700 A * 11/1961
KR 200405450 Y1 * 1/2006

(Continued)

*Primary Examiner* — Stanton L Krycinski
(74) *Attorney, Agent, or Firm* — MUNCY, GEISSLER, OLDS & LOWE, P.C.

(57) ABSTRACT

The present invention relates to the technical field of shelves, particularly to a highly flexible shelf device, comprising a pallet and a plurality of divider modules and further comprising a plurality of cover plates and a plurality of position adjusting blocks. The divider modules are provided with a plurality of mounting positions, and the position adjusting blocks are mounted on the cover plates and detachably inserted in the mounting positions. The plurality of divider modules are spaced on the pallet, goods placement areas are formed between adjacent divider modules, and each placement area is covered with at least one of the cover plates. The present invention provides a highly flexible shelf device and adds the setting of the position adjusting blocks inserted in the mounting positions, thereby fixing the cover (Continued)

plates to the divider modules by means of the position adjusting blocks, i.e., facilitating the adjustment of the positions of the cover plates without affecting the stability of the cover plates and making the use more flexible.

9 Claims, 7 Drawing Sheets

(56) References Cited

U.S. PATENT DOCUMENTS 5,803,276 A * 9/1998 Vogler ..... A47F 5/005 211/184
5,819,982 A * 10/1998 Brown ..... A47F 1/126 221/312 R
6,076,670 A * 6/2000 Yeranossian ..... A47F 1/126 221/124
6,142,317 A * 11/2000 Merl ..... A47F 1/126 211/59.3
7,419,062 B2 * 9/2008 Mason ..... A47F 1/126 211/59.3
8,020,714 B2 * 9/2011 Miller, Jr. ..... A47F 3/0404 108/107
8,047,385 B2 * 11/2011 Hardy ..... A47B 73/006 211/59.3
8,066,128 B2 * 11/2011 Crawbuck ..... A47F 1/125 211/59.3
8,172,094 B2 * 5/2012 Meyer ..... A47F 5/005 211/59.3
8,276,766 B2 * 10/2012 Rataiczak, III ..... A47F 1/126 211/59.3
8,556,092 B2 * 10/2013 Valiulis ..... A47F 5/005 211/175
8,925,745 B2 * 1/2015 Theisen ..... A47F 5/0043 211/119.003
9,578,976 B2 * 2/2017 Grubbs ..... A47F 5/005
9,901,188 B2 * 2/2018 Murphy ..... A47F 1/126
10,172,482 B2 * 1/2019 Pritchard ..... A47F 1/126
10,206,521 B2 * 2/2019 Murphy ..... A47F 3/002
10,334,967 B2 * 7/2019 Mercier ..... A47F 5/0093
10,398,238 B2 * 9/2019 Obitts ..... A47F 1/125
10,959,540 B2 * 3/2021 Padvoiskis ..... A47B 57/586
11,457,749 B2 * 10/2022 Pena ..... A47F 3/005
11,540,628 B2 * 1/2023 Brück ..... G08B 13/1436
2006/0180603 A1 * 8/2006 Eckert ..... G07F 11/42 211/59.3
2008/0257842 A1 * 10/2008 Mason ..... A47F 1/126 211/133.6
2010/0059469 A1 * 3/2010 Mason ..... A47F 1/126 221/199
2010/0107670 A1 * 5/2010 Kottke ..... A47F 5/0838 62/250
2011/0163113 A1 * 7/2011 Grubbs ..... A47F 1/125 221/311
2012/0266437 A1 * 10/2012 Camello ..... A47F 1/126 29/428
2013/0193156 A1 * 8/2013 Kaleta ..... A47F 1/126 221/247

FOREIGN PATENT DOCUMENTS

KR 200456820 Y1 * 11/2011
WO WO-9814099 A1 * 4/1998 ..... A47F 3/12
WO WO-03101258 A1 * 12/2003 ..... A47F 1/125

* cited by examiner

HIGHLY FLEXIBLE SHELF DEVICE

TECHNICAL FIELD

The present invention relates to the technical field of shelves, particularly to a highly flexible shelf device.

BACKGROUND ART

The goods shelf in the current market is generally divided by dividers into a plurality of spaces, which are used to place different goods. Each space is generally filled with a plurality of goods to allow for timely replenishment of the goods that are taken away. However, as many goods are placed in a space, there is a possibility of theft of the goods. As the spaces are not sheltered and protected, it is likely that many goods are stolen in a short period of time, resulting in losses of the shopping malls and other venues. In addition, although the shopping mall provides a cover to cover the entire shelf, when the cover is opened there is still a risk of theft of the goods. Therefore, there is an urgent need for a shelf structure that can reduce the risk of theft.

SUMMARY OF THE INVENTION

To address the problems in the prior art, the present invention provides a highly flexible shelf device and uses cover plates to cover placement areas to increase the difficulty of theft of the goods, thereby reducing the risk of theft of the goods. Further, position adjusting blocks are provided. The position adjusting blocks are inserted in mounting positions and achieve the adjustment of the relative positions of the cover plates and the divider modules, thereby adapting to different goods and making it difficult for different goods to be stolen.

To solve the above technical problem, the present invention adopts the following technical solution: the highly flexible shelf device comprises a pallet and a plurality of divider modules and further comprises a plurality of cover plates and a plurality of position adjusting blocks, the divider modules are provided with a plurality of mounting positions, the position adjusting blocks are mounted on the cover plates and detachably inserted in the mounting positions, the plurality of divider modules are spaced on the pallet, goods placement areas are formed between adjacent divider modules, and each placement area is covered with at least one of the cover plates.

Preferably, the plurality of the mounting positions are spaced apart, the position adjusting blocks are protruded with clamping blocks, and the clamping blocks are assembled in the mounting positions.

Preferably, clamping grooves are opened in the position adjusting blocks, the cover plates are clamped in the clamping grooves, the walls of the clamping grooves are protruded with bumps, clamping holes are opened in the cover plates, and the bumps are clamped in the clamping holes.

Preferably, each of the divider modules comprises a fixed plate and an adjusting plate, which are detachably connected, and one of the cover plates is slidably mounted between the fixed plate and the adjusting plate.

Preferably, the divider modules are 5 mm thick.

Preferably, the highly flexible shelf device further comprises push-pull modules used for pushing goods to move on the pallet.

Preferably, each of the push-pull modules comprises a push plate and a resilient member, one end of the resilient member is mounted on a divider module, the other end of the resilient member is mounted on the push plate, and the push plate is slidably arrange on the divider module.

Preferably, the push-pull module further comprises a slider, the slider is slidably connected to the divider module, and the push plate is mounted on the slider.

Preferably, a spacing adjuster is arranged on each of the two sides of the pallet and provided with a plurality of slots, and a fixing leg is mounted at the bottom of the fixed plate of the divider module and inserted in the slot.

Preferably, the highly flexible shelf device further comprises mounting plates, which are mounted on a side of the pallet and protruded with a plurality of hooks.

Preferably, the highly flexible shelf device further comprises a baffle, which is rotatably mounted under the pallet.

Preferably, a shelf is arranged under the pallet and comprises a fixing rack, a retractable rack and a retraction control module, the pallet is detachably mounted on the retractable rack, the retractable rack is slidably connected to the fixing rack, the retraction control module comprises a pull-out piece and a locking piece, one end of the pull-out piece is rotatably arranged on the retractable rack, the other end of the pull-out piece is connected to one end of the locking piece, a first lock hole is opened in the retractable rack, and the other end of the locking piece is movably inserted in the first lock hole.

Advantages of the Present Invention

1. Cover plates are provided above goods placement areas to cover the goods, thereby meeting the needs for goods display and access for sales purpose and increasing the difficulty of mass theft of the goods. It is difficult to take out the goods covered by the cover plates without permission and it takes more time to steal the goods, thereby improving the use security of the highly flexible shelf device provided by the present invention;
2. A plurality of mounting positions are arranged on each divider module, and the position adjusting blocks are mounted on the cover plates and then inserted to different mounting positions to adjust the positions of the cover plates. Further, the position adjusting blocks make the cover plates not slide easily and more stable and flexible.

Figure 1:
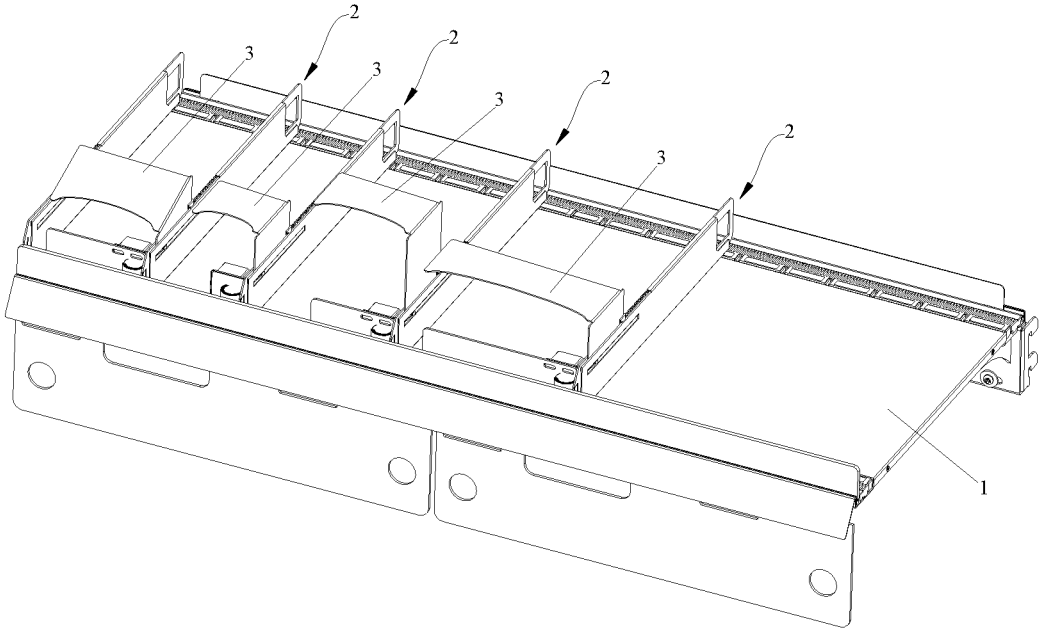
FIG. 1 is a structural schematic view 1 of a highly flexible shelf device provided by the present invention.

The reference signs in FIG. 1 to FIG. 10 include:

1—pallet, 2—divider module, 3—cover plate, 4—position adjusting block, 5—mounting position, 7—clamping block, 8—clamping groove, 9—bump, 10—clamping hole, 11—fixing plate, 12—adjusting plate, 13—push plate, 14—resilient member, 15—slider, 16—spacing adjuster, 17—slot, 18—fixing leg, 19—mounting plate, 20—hook, 21—baffle, 22—shelf, 23—fixing rack, 24—retractable rack, 25—pull-out piece, 26—locking piece.

DETAILED DESCRIPTION

To facilitate the understanding of those skilled in the art, below the present invention is further described in conjunction with embodiments and drawings. The content mentioned in the embodiments is not a limitation to the present invention. Below the present invention is elaborated by referring to the drawings.

Figure 2:
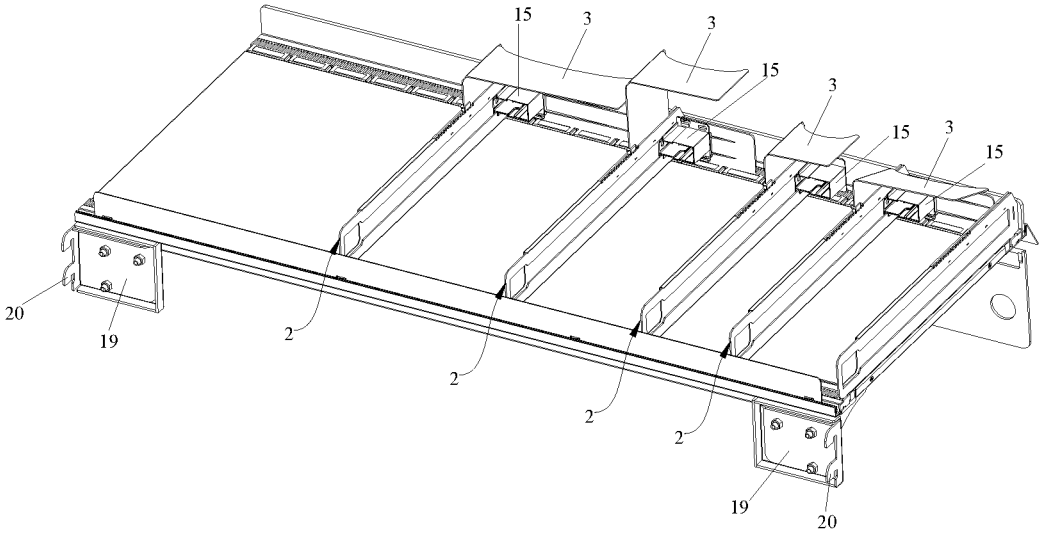
FIG. 2 is a structural schematic view 2 of a highly flexible shelf device provided by the present invention.
Figure 3:
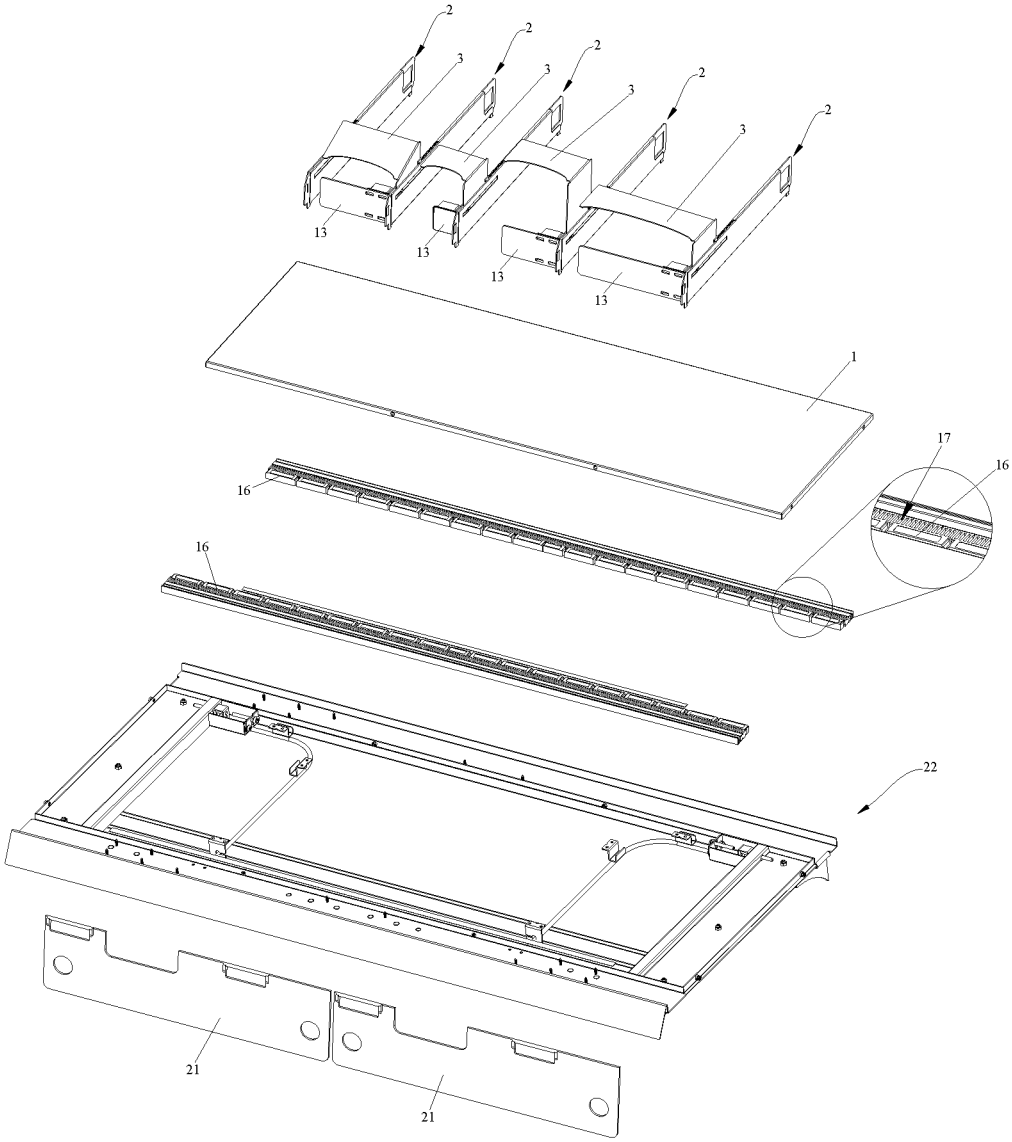
FIG. 3 is an exploded structural schematic view of a highly flexible shelf device provided by the present invention.

This embodiment provides a highly flexible shelf device, as shown in FIG. 1 to FIG. 3, comprising a pallet 1, a plurality of divider modules 2, a plurality of cover plates 3 and a plurality of position adjusting blocks 4. The divider modules 2 are provided with a plurality of mounting positions 5. The position adjusting blocks 4 are mounted on the cover plates 3 and detachably inserted in the mounting positions 5. The plurality of divider modules 2 are spaced on the pallet 1, goods placement areas are formed between adjacent divider modules 2 and each placement area is covered with at least one of the cover plates 3.

Figure 6:
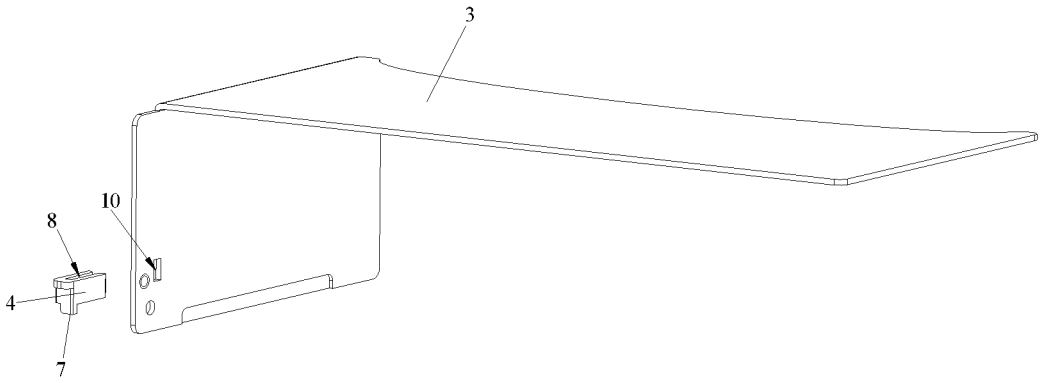
FIG. 6 is a structural schematic view of a cover plate and an position adjusting block in the present invention.
Figure 7:
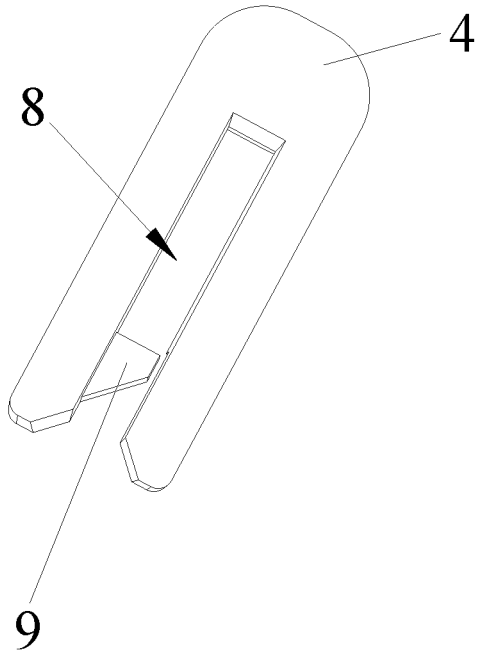
FIG. 7 is a structural schematic view of an position adjusting block in the present invention.

Specifically, as shown in FIG. 1 and FIG. 2, goods placement areas are formed between adjacent divider modules 2. If no cover plates 3 are provided, mass theft of goods may occur. Therefore, in order to avoid mass loss of goods, a cover plate 3 is arranged over each placement area in this embodiment. The structural shape of the cover plates 3 is as shown in FIG. 6, which is a "L" shape. Therefore, one end of each cover plate 3 is inserted into a divider module 2, the other end of the cover plate 3 covers the placement area, and partial space is reserved for user's access of the goods. The cover plates 3 in this embodiment can raise the difficulty of theft of goods and lengthen the time spent on mass theft of goods, thereby providing more time for the protection of the goods and reducing the risk of theft of goods. Further, in order to adapt to different sizes of goods, the space of the cover plates 3 reserved for access of the goods should be flexibly adjustable. For this reason, position adjusting blocks 4 are additionally provided in this embodiment. A plurality of mounting positions 5 are arranged on the divider modules 2 and dentation is formed among the plurality of mounting positions 5. Assembly principle: The cover plates 3 can be movably inserted into the divider modules 2, the position adjusting blocks 4 are mounted on the cover plates 3, and after the cover plates 3 are adjusted to appropriate positions, the position adjusting blocks 4 mounted on the cover plates 3 are inserted to the corresponding mounting positions 5, so that the relative positions of the cover plates 3 and the divider modules 2 are fixed, and the cover plates 3 will not slide spontaneously. That is, to adjust the position of a cover plate 3, you only need to shift the position adjusting block 4 to a different mounting position 5. The operation is simple. Further, the assembly of the position adjusting blocks 4 and the divider modules 2 is simple and does not need screws and other complex mounting structures.

Figure 4:
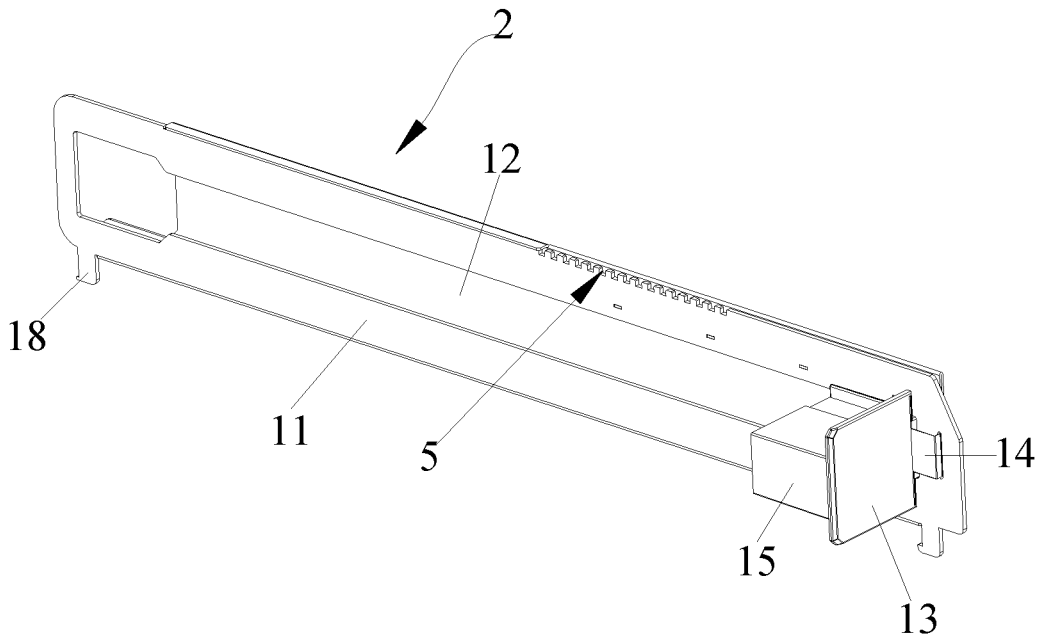
FIG. 4 is a structural schematic view of a divider module and a push-pull module in the present invention.
Figure 5:
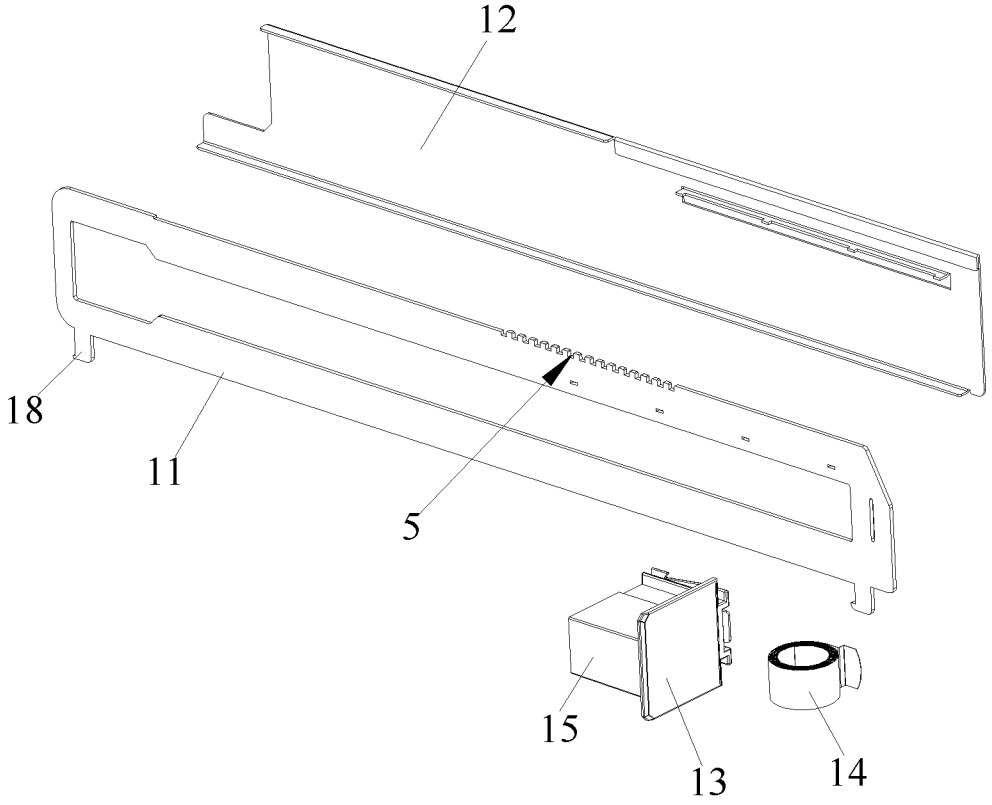
FIG. 5 is an exploded structural schematic view of FIG. 4.

Further, as shown in FIG. 4 and FIG. 5, the plurality of the mounting positions 5 are spaced apart, the position adjusting blocks 4 are convexly provided with clamping blocks 7, and the clamping blocks 7 are assembled in the mounting positions 5. Specifically, the clamping blocks 7 are arranged at the bottom of the position adjusting blocks 4 and can be directly inserted into the dentated mounting positions 5. The operation is convenient and flexible to facilitate position adjustment of the cover plates 3.

Further, FIG. 3 and FIG. 6 show the assembly structure of the position adjusting blocks 4 and the cover plates 3, clamping grooves 8 are opened in the position adjusting blocks 4, the cover plates 3 are clamped in the clamping grooves 8, the walls of the clamping grooves 8 are convexly provided with bumps 9, clamping holes 10 are opened in the cover plates 3, and the bumps 9 are clamped in the clamping holes 10.

Specifically, each of the divider modules 2 in this embodiment optionally comprises a fixed plate 11 and an adjusting plate 12, which are detachably connected. As shown in FIG. 4 and FIG. 5, a space accommodating a cover plate 3 is formed between the fixed plate 11 and the adjusting plate 12, and the cover plate 3 is inserted into this space and is slidable, so that the position of the cover plate 3 can be adjusted by directly pulling the cover plate 3, and also the cover plate 3 is fixed without having to be separated from the divider module 2, moved to a corresponding position and then inserted into a mounting position 5 via the position adjusting block 4. Therefore, the assembly of the position adjusting blocks 4 and the cover plates 3 only require locating the position adjusting blocks 4 onto the cover plates 3. In this embodiment, a clamping hole 10 is opened in each of the cover plates 3, the position adjusting blocks 4 are provided with clamping grooves 8, the portion of the position adjusting blocks 4 provided with the clamping grooves 8 is an approximately "U"-shaped structure, and the cover plates 3 are clamped in the clamping grooves 8 of the position adjusting blocks 4. The position adjusting blocks 4 are further provided with bumps 9. When the cover plates 3 are clamped in the clamping grooves 8, the bumps 9 are clamped in the clamping holes 10 of the cover plates 3, so that the position adjusting blocks 4 are fixed on the cover plates 3. Therefore, by inserting the position adjusting block 4 into the mounting position 5, and accordingly, inserting the cover plate 3 between the fixed plate 11 and the adjusting plate 12, the position of the cover plate 3 on the divider module 2 can be adjusted conveniently and quickly.

As an alternative implementation mode of the divider modules 2 in this embodiment, the fixed plate 11 and the adjusting plate 12 are fixedly assembled. In other words, a detachable structure is not needed and instead, only a space for sliding of the cover plate 3 is needed on each of the divider modules 2. Further, the thickness of the divider modules 2 in this embodiment can be optionally set to 5 mm, which is relatively thin, so the space of the goods placement areas can be increased, thereby accommodating more goods.

This embodiment provides a highly flexible shelf device. As shown in FIG. 4 and FIG. 5, the highly flexible shelf device further comprises push-pull modules used for pushing goods to move on the pallet 1.

Specifically, each of the push-pull modules comprises a push plate 13 and a resilient member 14, one end of the resilient member 14 is mounted on a divider module 2, the other end of the resilient member 14 is mounted on the push plate 13, and the push plate 13 is slidably arranged on the divider module 2. The push-pull module further comprises a slider 15. As shown in FIG. 4, the slider 15 is slidably connected to the divider module 2, and the push plate 13 is mounted on the slider 15. The resilient member 14 can be a spring, with one end fixed on the divider module 2. As shown in FIG. 4 and FIG. 5, a via hole (not shown in the figures) is opened on a side of the push plate 13 adjacent to the divider module 2, and the other end of the resilient member 14 passes through the via hole and then is fixed to the push plate 13 or the slider 15, so when goods are taken out for use, the push plate 13 will, under the elastic force of the resilient member 14, push other goods to fill the space. Alternatively, the resilient member 14 can be a rolling structure as shown in FIG. 5 and likewise, one end of the resilient member 14 is fixed on the divider module 2 and the other end passes through the via hole of the push plate 13 and then is rolled inside the slider 15. Therefore, the rolling and unrolling of the resilient member 14 can drive the push plate 13 to move automatically, so that after goods are taken away, other goods can be controlled to fill the space in time. As an alternative implementation mode of this embodiment, the pallet 1 can be mounted in a slant manner so that goods can automatically fill the space under the drive of gravity though the goods might be stuck, causing failure to fill the space in time. The implementation mode can be set according to the actual condition.

This embodiment provides a highly flexible shelf device. As shown in FIG. 3, a spacing adjuster 16 is mounted on each of the two sides of the pallet 1 and provided with a plurality of spaced slots 17, and a fixing leg 18 is mounted at the bottom of the fixed plate 11 of the divider module 2 and inserted in a slot 17.

Specifically, the spacing adjuster 16 is provided with a plurality of spaced slots 17, and by inserting the fixing leg 18 of the fixed plate 11 into different slot 17, the position of the fixed plate 11 can be changed, thereby adjusting the space between adjacent divider modules 2 and changing the size of the goods placement area to adapt to different goods.

Figure 8:
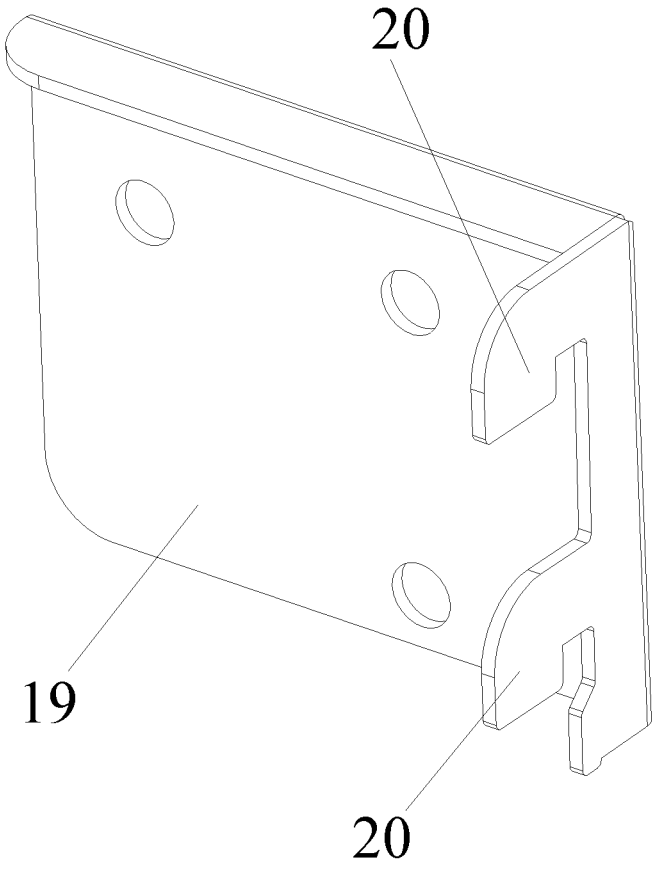
FIG. 8 is a structural schematic view of a mounting plate in the present invention.

This embodiment provides a highly flexible shelf device. As shown in FIG. 2 and FIG. 8, the highly flexible shelf device further comprises mounting plates 19, which are mounted on a side of the pallet 1 and convexly provided with a plurality of hooks 20.

Specifically, for easier installation, mounting plates 19 are arranged on a side of the pallet 1, and hooks 20 are arranged on the mounting plates 19. The mounting plates 19 and the hooks 20 are as shown in FIG. 8. During installation, the hooks 20 are hung to corresponding positions on the wallboard. The installation method is simple and easy to operate. In actual operation, by only setting the strength of the mounting plates 19 and the hooks 20 and the strength of the wallboard, desirable stability of the highly flexible shelf device in this embodiment can be assured after mounting.

Figure 9:
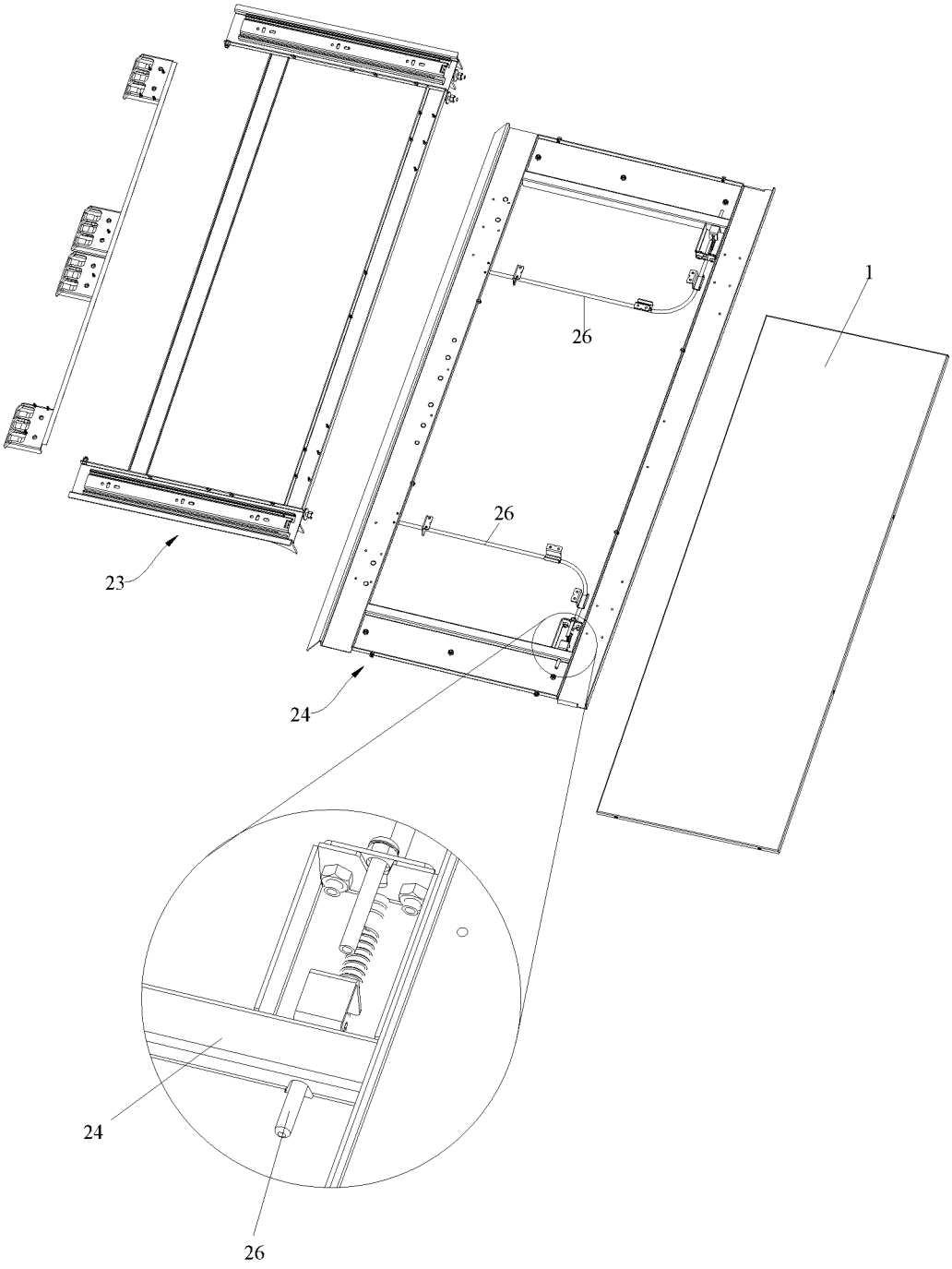
FIG. 9 is an exploded structural schematic view of a shelf in the present invention.
Figure 10:
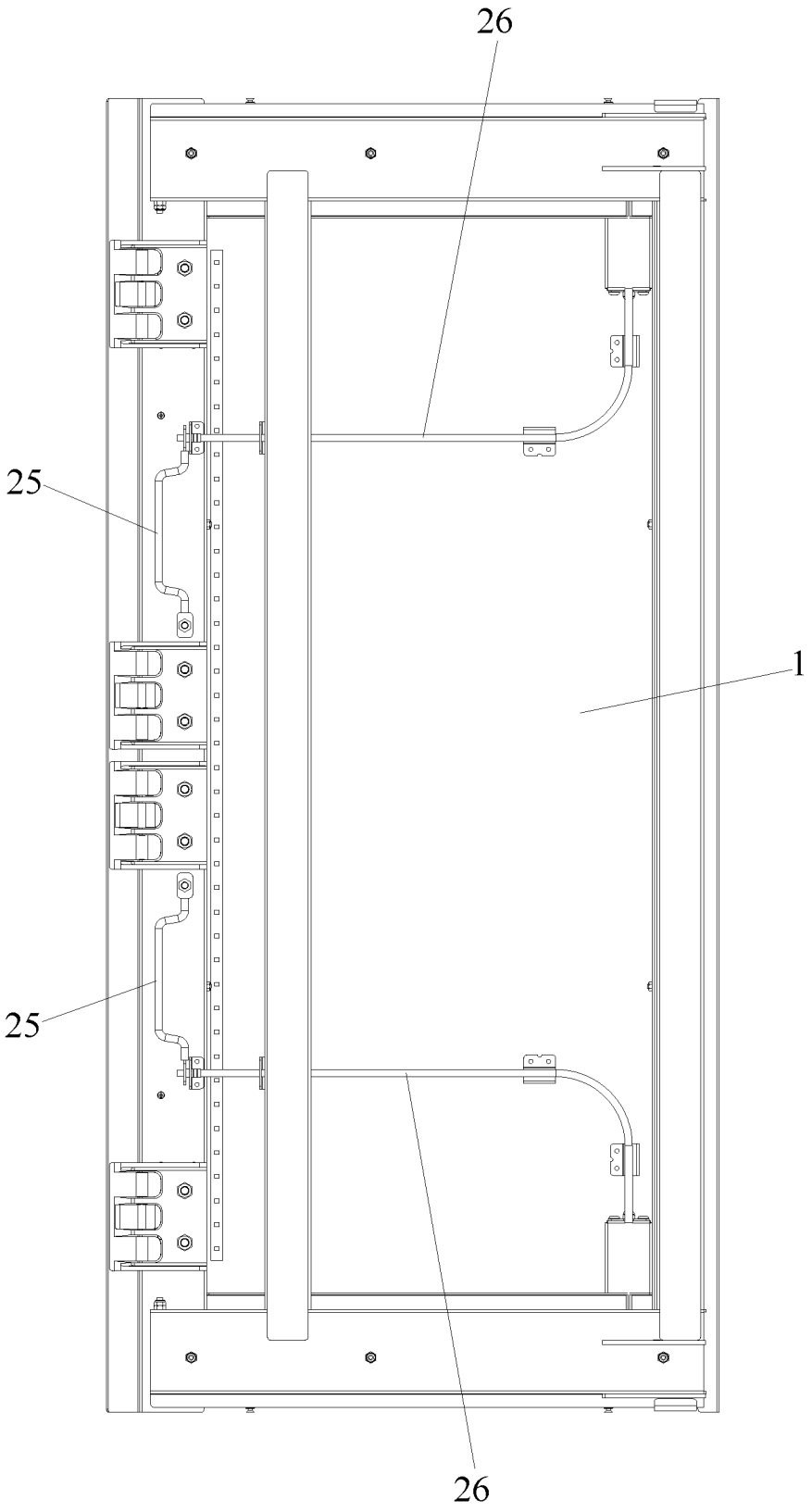
FIG. 10 is a top view of a shelf in the present invention.

This embodiment provides a highly flexible shelf device. As shown in FIG. 3, FIG. 9 and FIG. 10, the highly flexible shelf device further comprises a baffle 21 arranged on the pallet 1. The baffle 21 is rotatably arranged under the pallet 1 and is located on a side of the pallet 1 away from the mounting plates, so that by adjusting the mounting angle of the baffle 21, the difficulty of stealing the goods on the pallet 1 can be raised further.

Still further, a shelf 22 is arranged under the pallet 1 in this embodiment and comprises a fixing rack 23, a retractable rack 24 and a retraction control module. The pallet 1 is detachably mounted on the retractable rack 24. The retraction control module comprises a pull-out piece 25 and a locking piece 26. One end of the pull-out piece 25 is rotatably arranged on the retractable rack 24, the other end of the pull-out piece 25 is connected to one end of the locking piece 26, a first lock hole (not shown in the figure) is opened in the retractable rack 24, and the other end of the locking piece 26 is movably inserted in the first lock hole.

Specifically, for easier replenishment of goods, the pallet 1 is set to be a retractable structure in this embodiment. The assembly structure of the shelf 22 is shown in FIG. 9 and FIG. 10. The retraction control module is located at the bottom of the pallet 1. When goods need to be replenished, the pull-out piece 25 is pulled to rotate. The pull-out piece 25 pulls the locking piece 26 out of the first lock hole to unlock the fixing rack 23 and the retractable rack 24. Then the user pulls the retractable rack 24 to move. The retractable rack 24 drives the pallet 1 to move. In this way, the user has a larger operation space. After goods are replenished on the pallet 1, the pallet 1 is pushed back to the original position and the pull-out piece 25 is released so that the locking piece 26 returns to the original position and is inserted into the first lock hole, thereby locking the retractable rack 24 and the fixing rack 23 from movement. As shown in FIG. 10, the retraction control module is located at the bottom of the pallet 1 to prevent other people from seeing the retraction control module to some extent. The locking piece 26 optionally comprises a retraction channel fixed under the pallet 1 and a resilient member assembled inside the retraction channel. One end of the resilient member is connected to the pull-out piece 25, the other end of the resilient member is connected to a thrust roller, and the thrust roller can be inserted into the first lock hole. Therefore, the resilient member can be pulled by means of the pull-out piece 25 and drive the thrust roller out of the first lock hole, so that the fixing rack 23 and the retractable rack 24 can change their relative positions. Of course, the locking piece 26 can be a connecting rod in the shape shown in FIG. 10, too, and by controlling the movement of this connecting rod, locking and unlocking can be achieved.

The above description is a preferred embodiment of the present invention and not a limitation to the present invention in any form. Although the present invention is disclosed above in the form of a preferred embodiment, the preferred embodiment is not intended to limit the present invention. The alterations or modifications made by any one skilled in the art to the technical content disclosed above without departing from the scope of the technical solution of the present invention are equivalent embodiments of equivalent changes. All the simple alterations, equivalent changes and modifications made to the above embodiment without departing from the content of the technical solution of the present invention shall fall within the scope of the technical solution of the present utility model.

The invention claimed is:

1. A highly flexible shelf device, comprising a pallet and a plurality of divider modules, wherein the highly flexible shelf device further comprises a plurality of cover plates and a plurality of position adjusting blocks, the divider modules are provided with a plurality of mounting positions, the position adjusting blocks are mounted on the cover plates and detachably inserted in the mounting positions, the plurality of divider modules are spaced on the pallet, goods placement areas are formed between adjacent divider modules, and each placement area is covered with at least one of the cover plates, wherein clamping grooves are opened in the position adjusting blocks, the cover plates are clamped in the clamping grooves, walls of the clamping grooves are protruded with bumps, clamping holes are opened in the cover plates, and the bumps are clamped in the clamping holes.

2. The highly flexible shelf device according to claim 1, wherein the plurality of the mounting positions are spaced apart, the position adjusting blocks are protruded with clamping blocks, and the clamping blocks are assembled in the mounting positions.

3. The highly flexible shelf device according to claim 1, wherein each of the divider modules comprises a fixed plate and an adjusting plate, which are detachably connected, and one of the cover plates is slidably mounted between the fixed plate and the adjusting plate.

4. The highly flexible shelf device according to claim 1, wherein the divider modules are 5 mm thick.

5. The highly flexible shelf device according to claim 1, wherein the highly flexible shelf device further comprises push-pull modules used for pushing goods to move on the pallet, each of the push-pull modules comprises a push plate, a slider and a resilient member, one end of the resilient member is mounted on one of the divider modules, the other end of the resilient member is mounted on the push plate, the push plate is slidably arranged on the divider module, the slider is slidably connected to the divider module, and the push plate is mounted on the slider.

6. The highly flexible shelf device according to claim 3, wherein a spacing adjuster is arranged on each of two sides of the pallet and provided with a plurality of slots, and a fixing leg is mounted at a bottom of the fixed plate of the divider module and inserted in the slots.

7. The highly flexible shelf device according to claim 1, wherein the highly flexible shelf device further comprises mounting plates, which are mounted on a side of the pallet and protruded with a plurality of hooks.

8. The highly flexible shelf device according to claim 1, wherein the highly flexible shelf device further comprises a baffle, which is rotatably mounted under the pallet.

9. The highly flexible shelf device according to claim 1, wherein a shelf is arranged under the pallet and comprises a fixing rack, a retractable rack and a retraction control module, the pallet is detachably mounted on the retractable rack, the retractable rack is slidably connected to the fixing rack, the retraction control module comprises a pull-out piece and a locking piece, one end of the pull-out piece is rotatably arranged on the retractable rack, the other end of the pull-out piece is connected to one end of the locking piece, a first lock hole is opened in the retractable rack, and the other end of the locking piece is movably inserted in the first lock hole.

* * * * *